US010791392B2

(12) United States Patent
Lai et al.

(10) Patent No.: US 10,791,392 B2
(45) Date of Patent: Sep. 29, 2020

(54) SPEAKER

(71) Applicant: MERRY ELECTRONICS (SHENZHEN) CO., LTD., Guangdong (CN)

(72) Inventors: Tsai-Ti Lai, Taichung (TW); Sheng-Yuan Hsiao, Taichung (TW); Ling-Chiu Hsiang, Taichung (TW)

(73) Assignee: MERRY ELECTRONICS (SHENZHEN) CO., LTD., Guangdong (CN)

( * ) Notice: Subject to any disclaimer, the term of this patent is extended or adjusted under 35 U.S.C. 154(b) by 0 days.

(21) Appl. No.: 16/436,899

(22) Filed: Jun. 10, 2019

(65) Prior Publication Data

US 2019/0394560 A1 Dec. 26, 2019

(30) Foreign Application Priority Data

Jun. 21, 2018 (TW) ..... 107121361 A
May 15, 2019 (TW) ..... 108116783 A

(51) Int. Cl.
*H04R 1/28* (2006.01)
*H04R 9/02* (2006.01)

(52) U.S. Cl.
CPC ..... *H04R 1/2807* (2013.01); *H04R 1/2823* (2013.01); *H04R 1/2849* (2013.01); *H04R 9/025* (2013.01)

(58) Field of Classification Search
CPC ..... H04R 1/2807; H04R 1/2823
See application file for complete search history.

(56) References Cited

U.S. PATENT DOCUMENTS 5,729,605 A * 3/1998 Bobisuthi ..... H04R 1/1041 379/430
2013/0077800 A1* 3/2013 Pan ..... H04S 3/004 381/74
2017/0238088 A1* 8/2017 Wen ..... H04R 1/1058 381/373

* cited by examiner

*Primary Examiner* — Sunita Joshi
(74) *Attorney, Agent, or Firm* — CKC & Partners Co., LLC

(57) ABSTRACT

A speaker includes a frame and a partition wall. The frame has ribs to define a central through hole and plural side through holes. The partition wall is coupled with the frame to form a boundary between a high-pitched sound zone and a low-pitched sound zone, wherein a total sum area of the side through holes covered by the partition wall is smaller than a total sum area of the side through holes uncovered by the partition wall.

12 Claims, 5 Drawing Sheets

SPEAKER

CROSS-REFERENCE TO RELATED APPLICATION

This application claims priority to Taiwan Applications Serial Number 107121361, filed Jun. 21, 2018 and Serial Number 108116783, filed May 15, 2019 which are herein incorporated by reference in their entireties.

BACKGROUND

Field of Invention

The present disclosure relates to a speaker, and more particularly, to a speaker equipped with a high-pitched sound zone and a low-pitched sound zone.

Description of Related Art

Listening to music has become an indispensable part of modern life to regulate tension and monotony. Therefore, the sound quality of music produced by the speakers (such as speakers, headphones, etc.) of general consumer products and the experience of using the speaker to listening to music will affect consumption. As consumer demands for sound quality are also higher and higher, the requirements for speakers of general consumer products are increasingly taken care so as to improve the sound quality and the consumer experience.

Generally speaking, a speaker with a small volume, such as an earphone, is capable of accommodating single one sound-producing unit, which is difficult to simultaneously consider the sound experience of high-pitched and low-pitched sound. How to improve the output quality of high-pitched and low-pitched sound in smaller speakers is one of the focusing researches developed by speaker manufacturers.

SUMMARY

In one or more embodiments, a speaker includes a frame and a partition wall. The frame has ribs to define a central through hole and plural side through holes. The partition wall is coupled with the frame to form a boundary between a high-pitched sound zone and a low-pitched sound zone, wherein a total sum area of the side through holes covered by the partition wall is smaller than a total sum area of the side through holes uncovered by the partition wall.

In one or more embodiments, all the side through holes have lengthwise directions in parallel with one another.

In one or more embodiments, the side through holes are arranged along single row.

In one or more embodiments, the frame is a circular frame, and the side through holes have lengthwise directions in parallel with a radial direction of the circular frame.

In one or more embodiments, the frame is a circular frame, and the side through holes have lengthwise directions perpendicular to a radial direction of the circular frame.

In one or more embodiments, the central through hole is a circular hole.

In one or more embodiments, the side through holes are radially arranged around the central through hole.

In one or more embodiments, each side through hole covered by the partition wall is smaller than each side through hole uncovered by the partition wall.

In one or more embodiments, the high-pitched sound zone includes an electromagnetic component accommodating area and two discontinuous sound chamber extension areas.

In one or more embodiments, the side through holes covered by the partition wall includes two groups of side through holes, each group includes at least three long-strip holes.

In one or more embodiments, the side through holes uncovered by the partition wall includes two groups of side through holes, each group includes at least three long-strip holes.

In sum, the speaker disclosed herein has a partition wall to serve as a boundary between the high-pitched sound zone and the low-pitched sound zone, which allows the high-pitched sound and the low-pitched sound to be transmitted to and around in their respective zones so as to avoid mixing the high-pitched and low-pitched sounds, and the shape of the side through holes of the frame and a total sum area difference between the high and low pitched sound zones, thereby reducing the total harmonic distortion ratio and improving output quality for both sounds.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
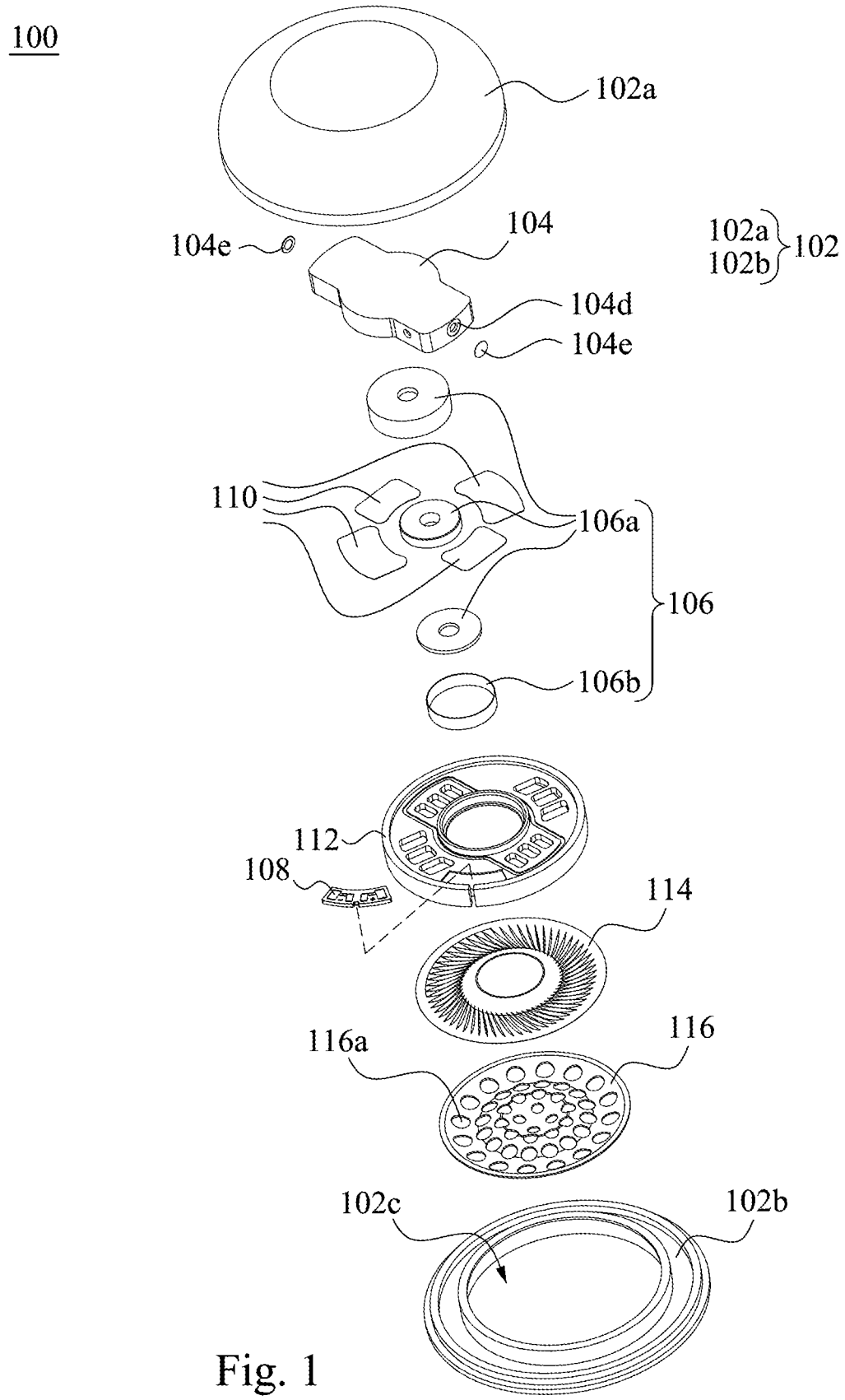
FIG. 1 illustrates an exploded view of a speaker according to one embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

Reference is made to FIG. 1, which illustrates an exploded view of a speaker according to one embodiment of the present disclosure. A speaker 100 includes a partition wall 104, a frame 112, a diaphragm 114, a front cover 116, an electromagnetic component 106 and a housing 102, etc.

The electromagnetic component 106 includes a voice coil 106*b* and a magnetic part assembly 106*a* consisting of several components. The voice coil 106*b* is electrically connected to a driver circuit board 108 and is used to drive a diaphragm 114 vibrating to produce sound.

When all parts of the speaker are assembled, an outer rear cover 102*a* and a headset cover 102*b* are assembled to form the housing 102, which wraps the remaining components inside thereof. The front cover 116 is secured to a central opening 102*c* of the headset cover 102*b* and has plural sound output holes 116*a*.

Figure 2:
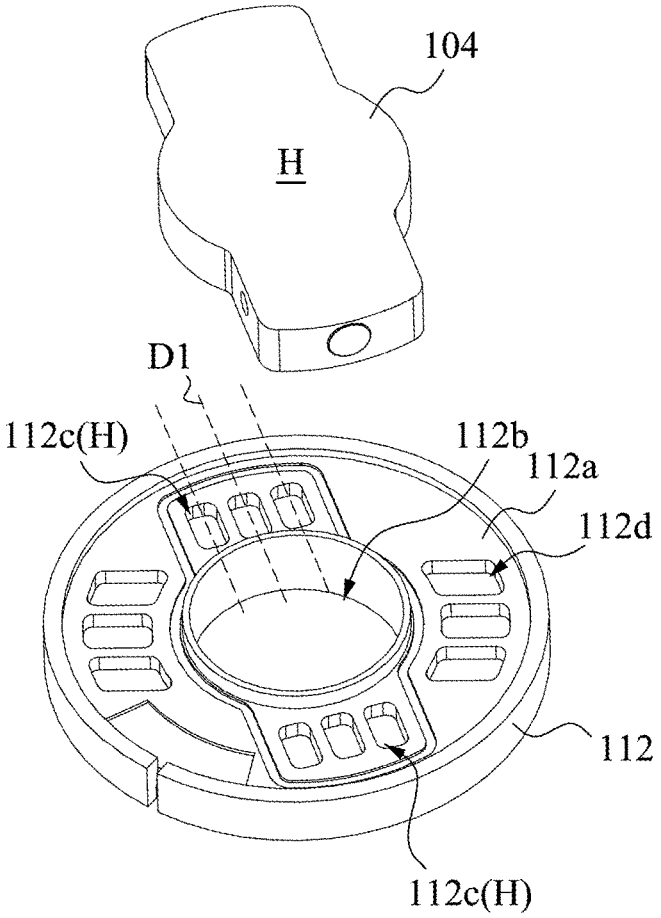
FIG. 2 illustrates an enlarged view of some components of the speaker in FIG. 1.
Figure 3:
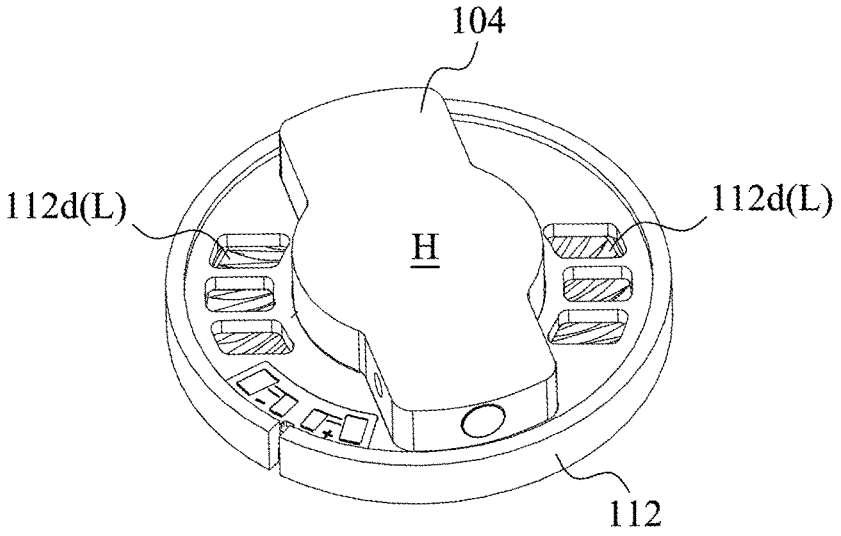
FIG. 3 illustrates a perspective view of a sound-producing unit within a speaker according to one embodiment of the present disclosure.
Figure 4:
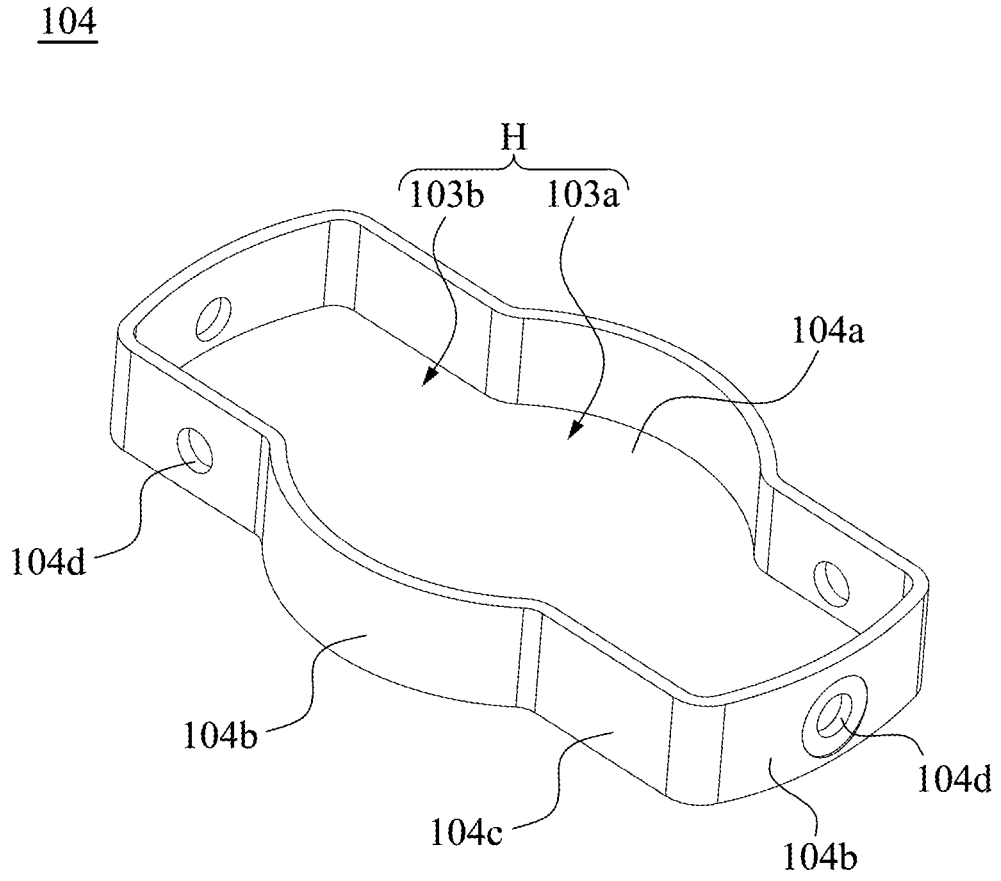
FIG. 4 illustrates a perspective view of a partition wall of the speaker in FIG. 2 from a different view point.

Reference is made to FIGS. 1-4. FIG. 2 illustrates an enlarged view of the partition wall 104 and the frame 112 of the speaker in FIG. 1, FIG. 3 illustrates a perspective view of a sound-producing unit within a speaker, and FIG. 4 illustrates a perspective view of a partition wall of the speaker in FIG. 2 from a different view point.

The partition wall 104 is secured to the frame 112 to serve as a sound wave boundary between a high-pitched sound zone (H) and a low-pitched sound zone (L), e.g., forming a boundary to isolate sound waves in the high-pitched sound zone from sound waves in the low-pitched sound zone. The partition wall 104 basically consists of a top wall 104*a* and plural sidewalls. The plural sidewalls include flat sidewalls 104*c* and arc-shaped sidewalls 104*b*.

The frame 112 includes plural ribs 112*a* to define a central through hole 112*b* and plural side through holes (112*c*, 112*d*). When the partition wall 104 and the frame 112 are assembled, the partition wall 104 covers the central through hole 112*b* and the side through holes 112*c* of the frame 112. Therefore, the side through holes 112*c* covered by the partition wall 104 belong to the high-pitched sound zone (H), and the side through holes 112*d* uncovered and exposed by the partition wall 104 belong to low-pitched sound zone (L).

Mesh sheets 110 are utilized to cover the side through holes (112*c*, 112*d*) of the frame 112; or mesh sheets 110 are utilized to cover only the side through holes 112*d* of the frame 112.

In this embodiment, a total sum area of the side through holes 112*c* covered by the partition wall 104 is smaller than a total sum area of the side through holes 112*d* uncovered (exposed) by the partition wall 104.

In this embodiment, the side through holes (112*c*, 112*d*) are long-strip holes. The side through holes 112*c* have lengthwise directions (D1) in parallel with one another, or the side through holes 112*d* have lengthwise directions in parallel with one another, but not being limited to.

In this embodiment, the side through holes 112*c* or the side through holes 112*d* are arranged along single row, but not being limited to.

In this embodiment, the frame 112 is a circular frame, and the side through holes (112*c*, 112*d*) have lengthwise directions in parallel with a radial direction of the circular frame.

In this embodiment, the central through hole 112*b* of the frame 112 is a circular hole, and the side through holes (112*c*, 112*d*) are radially arranged around the central through hole 112*b*, but not being limited to.

In this embodiment, each side through hole 112*c* covered by the partition wall 104 is smaller than each side through hole 112*d* uncovered (exposed) by the partition wall 104, but not being limited to.

In this embodiment, the high-pitched sound zone (H), which is at least partially covered by the partition wall 104, includes an electromagnetic component accommodating area 103*a* and multiple discontinuous sound chamber extension areas 103*b*. The electromagnetic component accommodating area 103*a* is configured to accommodate the electromagnetic component 106, and named after this function.

In the embodiment of FIG. 3, the high-pitched sound zone H wrapped around by the partition wall 104 includes an electromagnetic component accommodating area 103*a* and two discontinuous sound chamber extension areas 103*b*, and the electromagnetic component accommodating area 103*a* is a circular region, the two discontinuous sound chamber extension areas 103*b* are discontinuous sector region, but not being limited to.

The electromagnetic component accommodating area 103*a* and the plural discontinuous sound chamber extension areas 103*b* of the high-pitched sound zone 103 are fluid-communicable, e.g., fluid may be flown from one sound chamber extension area 103*b* to another sound chamber extension area 103*b* via the electromagnetic component accommodating area 103*a*.

When all parts of the speaker are assembled, the electromagnetic component accommodating area 103*a* of the high-pitched sound zone (H) is configured to cover the central through hole 112*b* of the frame 112, and the plural discontinuous sound chamber extension areas 103*b* of the high-pitched sound zone (H) are configured to cover the side through holes 112*c* and expose the remaining side through holes 112*d*.

Each side through hole 112*d* is located in a section defined by the electromagnetic component accommodating area 103*a* and any immediately-two of the plural discontinuous sound chamber extension areas 103*b*, and the mesh sheets 110 are used to cover the side through holes 112*d*.

In this embodiment, each mesh sheet 110 covers a corresponding one of the plural side through holes 112*c* or 112*d*, but not being limited to.

In this embodiment, the sidewalls (104*b*, 104*c*) of the sound chamber extension area 103*b* have at least one vent hole 104*d*, and have a flow-regulation member 104*e* attached over the at least one vent hole 104*d*, e.g., the flow-regulation member 104*e* is attached to the sidewall to cover the vent hole 104*d*. Both flow-regulation member 104*e* and the mesh sheet 110 are porous ventilating members, which distribute airflow evenly between the high-pitched sound zone and low-pitched sound zone to maintain the air pressure consistently.

The partition wall 104 forms a boundary between the high-pitched sound zone (H) and the low-pitched sound zone (L). The high-pitched sound zone (H) is a zone wrapped by the partition wall 104 and the front cover 116 while the low-pitched sound zone (L) is a zone wrapped by the partition wall 104, mesh sheet 110 and the housing 102 of the speaker (including the outer rear cover 102*a* and the headset cover 102*b*). In actual practice, the low-pitched sound zone (L) has a greater volume than that of the high-pitched sound zone (H), but not being limited to. The high-pitched sound zone (H) and low-pitched sound zone (L) are not entirely isolated by the partition wall 104, which have vent holes 104*d* and flow-regulation members 104*e* to distribute airflow evenly in both sound zones.

Figure 5:
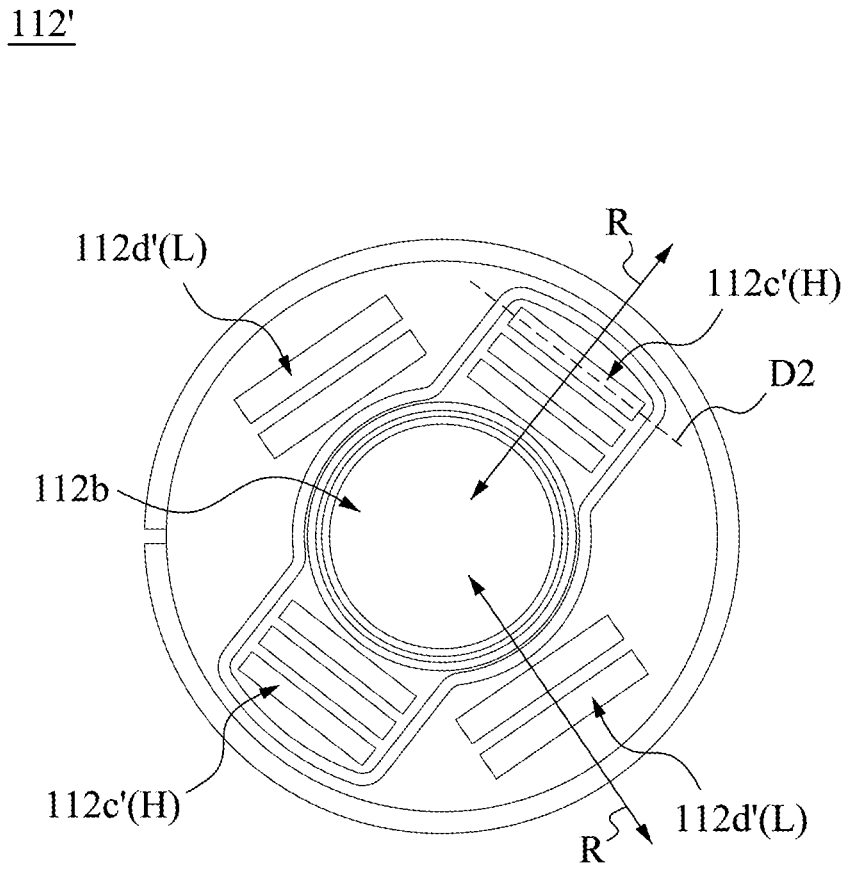
FIG. 5 illustrates a top view of a frame according to another embodiment of the present disclosure.

FIG. 5 illustrates a top view of a frame according to another embodiment of the present disclosure. The frame 112' is different from the frame 112 in an orientation between a lengthwise direction of the side through hole and a radial direction of the frame. In this embodiment, the lengthwise direction of the side through hole is substantially perpendicular to the radial direction R of the circular frame 112', for example, the lengthwise direction D2 of the side through hole 112*c'* is substantially perpendicular to the radial direction R of the circular frame 112'. The lengthwise direction of the side through hole 112*d'* is also substantially perpendicular to the radial direction R of the circular frame 112'. Similar to the frame 112 design, a total sum area of the side through holes 112*c'* of the frame 112' is smaller than a total sum area of the side through holes 112*d'*.

Figure 6:
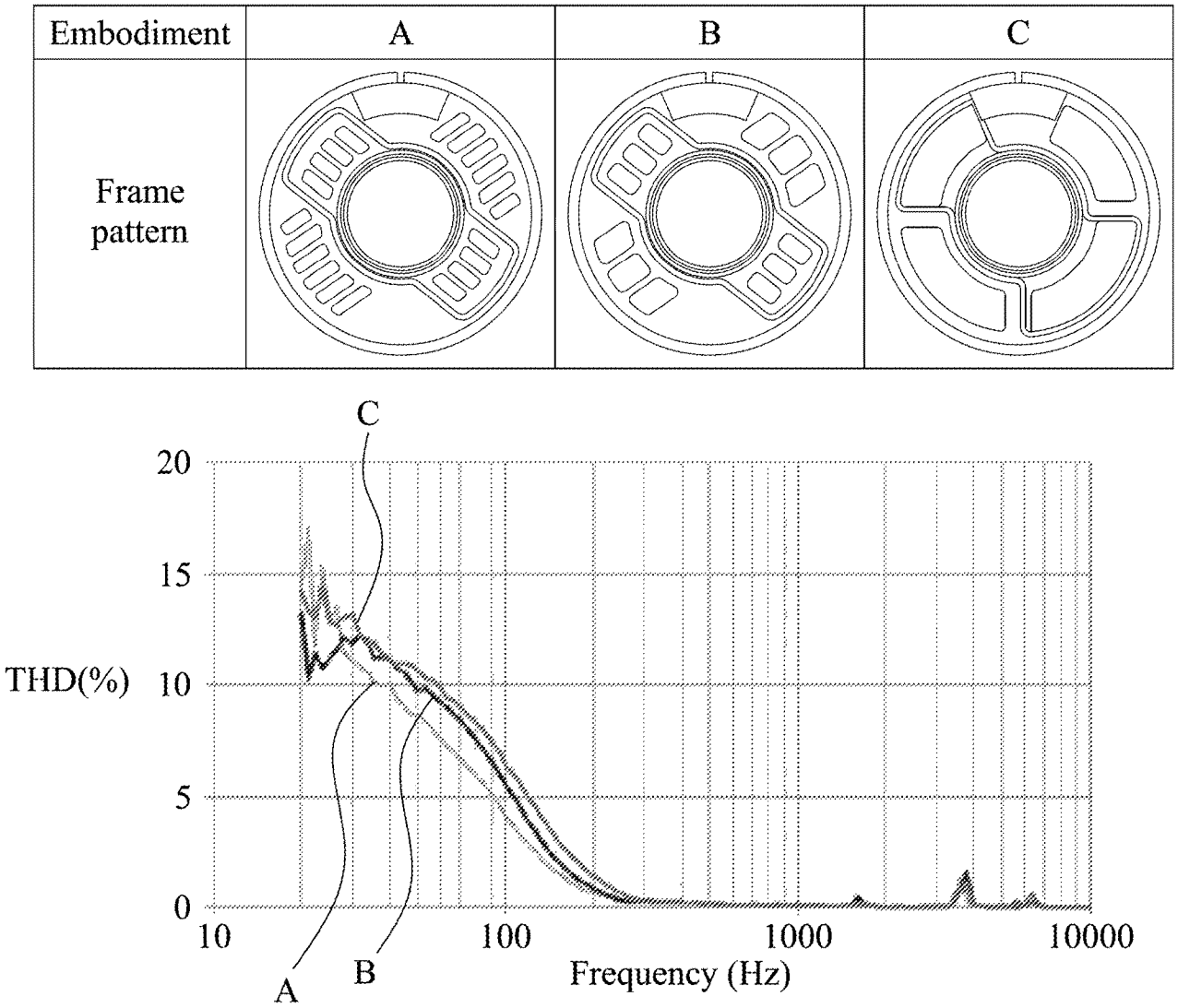
FIG. 6 illustrates a THD diagram of speakers according to different embodiments of the present disclosure.

FIG. 6 illustrates a THD diagram of speakers according to different embodiments of the present disclosure. The speaker embodiments compared in this figure contain three kinds of frames, namely, embodiments A, B, and C, and the drawings of frames are shown in the figure respectively. In the embodiment A, a total sum area of the side through holes (4×2 through holes) within the high-pitched sound zone of is smaller than a total sum area of the side through holes (6×2 through holes) in the low-pitched sound zone. In the embodiment B, a total sum area of the side through holes (3×2 smaller through holes) within the high-pitched sound zone is smaller than a total sum area of the side through holes (3×2 larger through holes) within the low-pitched sound zone. In the embodiment C, a total sum area of the side through holes within the high-pitched sound zone is equal to a total sum area of the side through holes within the low-pitched sound zone. Comparing the Total Harmonic Distortion (THD) ratio curves corresponding to the embodiments A, B, and C, it can be seen that in the ratio of a total harmonic distortion of the speaker output sound, the speaker of embodiment A is smaller than the speaker of embodiment B, and the speaker of embodiment B is smaller than the speaker of embodiment C between 30 Hz and 200 Hz. Specifically, at a frequency of 100 Hz, the total harmonic distortion ratio of the embodiment A is 4.17%, the total harmonic distortion ratio of the embodiment B is 5.60%, and the total harmonic distortion ratio of the embodiment C is 6.53%. At a frequency of 200 Hz, the total harmonic distortion ratio of the embodiment A is 0.66%, the total harmonic distortion ratio of the embodiment B is 0.87%, and the total harmonic distortion ratio of the embodiment C is 1.43%. The lower the total harmonic distortion ratio, the more realistic the output sound of the speaker. In addition, the long-strip side through holes designed on the frames of the embodiments A and B are also beneficial to reduce the total harmonic distortion ratio.

In sum, the speaker disclosed herein has a partition wall to serve as a boundary between the high-pitched sound zone and the low-pitched sound zone, which allows the high-pitched sound and the low-pitched sound to be transmitted to and around in their respective zones so as to avoid mixing the high-pitched and low-pitched sounds, and the shape of the side through holes of the frame and a total sum area difference between the high and low pitched sound zones, thereby reducing the total harmonic distortion ratio and improving output quality for both sounds.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A speaker comprising:

a frame having ribs to define a central through hole and plural side through holes; and a partition wall coupled with the frame to cover the central through hole and part of the plural side through holes, and form a boundary between a high-pitched sound zone and a low-pitched sound zone, wherein a total sum area of the side through holes covered by the partition wall is smaller than a total sum area of the side through holes exposed by the partition wall.

2. The speaker of claim 1, wherein the side through holes are long-strip holes.

3. The speaker of claim 2, wherein all the side through holes have lengthwise directions in parallel with one another.

4. The speaker of claim 2, wherein the side through holes are arranged along single row.

5. The speaker of claim 2, wherein the frame is a circular frame, and the side through holes have lengthwise directions in parallel with a radial direction of the circular frame.

6. The speaker of claim 2, wherein the frame is a circular frame, and the side through holes have lengthwise directions perpendicular to a radial direction of the circular frame.

7. The speaker of claim 1, wherein the central through hole is a circular hole.

8. The speaker of claim 1, wherein the side through holes are radially arranged around the central through hole.

9. The speaker of claim 1, wherein each side through hole covered by the partition wall is smaller than each side through hole exposed by the partition wall.

10. The speaker of claim 1, wherein the high-pitched sound zone comprises an electromagnetic component accommodating area and two discontinuous sound chamber extension areas.

11. The speaker of claim 1, wherein the side through holes covered by the partition wall comprise two groups of side through holes, each group comprises at least three long-strip holes.

12. The speaker of claim 1, wherein the side through holes exposed by the partition wall comprise two groups of side through holes, each group comprises at least three long-strip holes.

* * * * *